US010874201B2

(12) United States Patent
Beckage

(10) Patent No.: US 10,874,201 B2
(45) Date of Patent: Dec. 29, 2020

(54) REMOVABLE STORAGE CLIP

(71) Applicant: Jennifer A Beckage, Williamsville, NY (US)

(72) Inventor: Jennifer A Beckage, Williamsville, NY (US)

( * ) Notice: Subject to any disclaimer, the term of this patent is extended or adjusted under 35 U.S.C. 154(b) by 0 days.

(21) Appl. No.: 16/385,849

(22) Filed: Apr. 16, 2019

(65) Prior Publication Data

US 2019/0313778 A1 Oct. 17, 2019

Related U.S. Application Data

(60) Provisional application No. 62/658,212, filed on Apr. 16, 2018.

(51) Int. Cl.

| | |
|---|---|
| ***A45F 5/02*** | (2006.01) |
| ***A45C 1/00*** | (2006.01) |
| ***A42B 1/24*** | (2006.01) |
| ***A45C 13/10*** | (2006.01) |
| ***A45C 11/00*** | (2006.01) |
| ***A45C 1/06*** | (2006.01) |

(52) U.S. Cl.

CPC ..... *A45F 5/02* (2013.01); *A45C 1/06* (2013.01); *A45C 11/00* (2013.01); *A45C 13/103* (2013.01); *A45C 13/1069* (2013.01); *A42B 1/241* (2013.01); *A45C 2011/007* (2013.01); *A45F 2200/055* (2013.01)

(58) Field of Classification Search

CPC ..... A45F 2200/055; A45C 2011/186; A45C 2200/10; A45C 1/06; A45C 11/182; A45C 13/103; A42B 1/241

USPC ..... 224/181, 587, 666, 268, 269, 183, 312; 24/910, 3.7, 530

See application file for complete search history.

(56) References Cited

U.S. PATENT DOCUMENTS

| | | | | | |
|---|---|---|---|---|---|
| 2,400,626 | A | * | 5/1946 | Brede | A41D 27/20 224/236 |
| 3,894,667 | A | * | 7/1975 | Baldocchi | A45F 5/02 224/666 |
| 4,060,876 | A | * | 12/1977 | De Soto | A45F 5/02 24/3.12 |
| 4,386,437 | A | | 6/1983 | Fosher | |
| 4,416,315 | A | * | 11/1983 | Foley | A45F 5/00 150/134 |
| 4,444,342 | A | * | 4/1984 | Powell | A45C 1/04 224/250 |
| 4,451,935 | A | | 6/1984 | Henschel | |
| 4,626,457 | A | * | 12/1986 | Willie | A45C 1/02 150/137 |
| 4,705,086 | A | * | 11/1987 | O'Neill | A45C 1/04 150/134 |
| 4,784,199 | A | * | 11/1988 | Wise | A45C 1/08 150/134 |
| 4,903,745 | A | * | 2/1990 | Roman | A45C 1/04 150/134 |

(Continued)

*Primary Examiner* — Justin M Larson

(74) *Attorney, Agent, or Firm* — Michael J. Berchou, Esq.; Harter Secrest & Emery LLP

(57) ABSTRACT

A storage system for containing personal items. The storage system including a storage unit for storing the personal items, the storage unit including an interior cavity for receiving the personal items; and a clip fastened to the storage unit, the clip being configured to be releasably attachable to an article of clothing.

6 Claims, 11 Drawing Sheets

(56) References Cited

U.S. PATENT DOCUMENTS 5,082,157 A * 1/1992 Emerson-Santos ..... A45C 1/04 224/587
5,103,884 A * 4/1992 Roman ..... A45F 5/02 150/134
5,141,141 A * 8/1992 Leone ..... A41F 11/16 2/312
5,215,237 A * 6/1993 Wu ..... A45C 1/06 150/132
5,233,703 A 8/1993 Galka
5,244,023 A * 9/1993 Spies ..... A45F 5/022 150/134
5,274,937 A * 1/1994 Birnbaum ..... G09F 7/04 206/818
5,452,479 A * 9/1995 Mostert ..... A42B 1/248 2/195.1
5,573,441 A * 11/1996 Smith ..... A41C 3/0035 150/134
5,592,767 A * 1/1997 Treske ..... G09F 3/207 24/3.11
D378,018 S * 2/1997 Ouellette ..... D3/215
5,697,127 A 12/1997 Tyler
5,704,070 A 1/1998 Stogner
5,743,449 A * 4/1998 McBride ..... A63C 11/00 224/191
5,785,221 A * 7/1998 Bishop ..... A45F 5/02 206/38
5,815,845 A * 10/1998 Ault ..... A45C 1/06 2/249
6,023,788 A 2/2000 McCallum et al.
6,082,600 A * 7/2000 Angus ..... A45C 1/04 224/236
6,170,087 B1 1/2001 Brannon
6,286,736 B1 * 9/2001 Angus ..... A45C 1/04 224/236
6,305,591 B1 * 10/2001 Jones ..... A45C 11/24 206/581
6,964,361 B2 * 11/2005 Kathrein ..... A45C 1/04 224/183
7,120,937 B2 10/2006 Monshouwer
8,661,720 B2 3/2014 Miller
8,985,413 B1 * 3/2015 Selsor ..... A45F 5/021 224/269
9,289,052 B2 3/2016 Griffith
9,603,402 B2 * 3/2017 Warner ..... A63F 13/00
9,669,292 B1 * 6/2017 Warner ..... A63F 13/00
9,918,542 B2 * 3/2018 Griffith ..... A45F 5/021
10,258,137 B2 * 4/2019 Quillmann ..... A45F 5/02
10,322,325 B2 * 6/2019 Farina ..... A47L 13/16
2004/0222253 A1 11/2004 Linch et al.
2004/0237166 A1 * 12/2004 Holden ..... A41D 27/20 2/69
2006/0011681 A1 * 1/2006 Raimondo ..... A45F 5/02 224/268
2006/0054647 A1 * 3/2006 Kathrein ..... A45C 1/04 224/183
2008/0163407 A1 7/2008 Gardner
2010/0300147 A1 12/2010 Farmer et al.
2011/0000941 A1 * 1/2011 Volk ..... A42B 1/241 224/181
2011/0280499 A1 * 11/2011 Brundage ..... A45F 5/02 383/11
2012/0112024 A1 5/2012 Gotzl
2013/0105528 A1 * 5/2013 Enayati ..... A45F 5/021 224/191
2014/0061261 A1 * 3/2014 Yakeley ..... A63B 57/00 224/183
2015/0320190 A1 11/2015 Gaudet et al.
2016/0029728 A1 * 2/2016 Byrd ..... A42B 1/24 224/181
2018/0027935 A1 * 2/2018 Laatz ..... A45C 1/06
2018/0049493 A1 * 2/2018 Graves ..... A41D 27/20
2018/0332936 A1 * 11/2018 Serman ..... A45C 1/06
2019/0266463 A1 * 8/2019 Wang ..... A45C 1/06
2019/0313778 A1 * 10/2019 Beckage ..... A45C 13/1023

* cited by examiner

REMOVABLE STORAGE CLIP

BACKGROUND OF THE INVENTION

The present invention relates generally to storage systems, and more specifically, to an improved removable storage wallet for articles of clothing.

Runners, ballplayers, persons at the gym, and other athletes may not have pockets to carry identification, money, key(s), Band-Aids, toothpick, medication in pill format, or other valuables on their person. Also, children who are playing, on field trips, or participating in sports, may require at times to carry identification, money, or other health items. Articles of clothing may not have any storage units attached thereto, which necessitates carrying a purse, bag, wallet, fanny pack, etc. to hold and put away money, business cards, license, credit cards, key(s), medications in pill form, or other storage items. These additional storage units are not only cumbersome but are also obtrusive.

Therefore, the inventor has developed a system and apparatus, in particular, a removable storage system, that can attach and increase storage capacity of an article of clothing while being unobtrusive.

BRIEF SUMMARY

An embodiment of the present disclosure provides for a storage system for containing personal items and removable attachment to an interior region of a hat having a sweatband. The storage system being imperceptible by a third party when positioned in the interior region of the hat. The storage system includes a storage unit being configured to be secure, waterproof, and for storing the personal items, the storage unit comprising: an interior cavity for receiving the personal items; and a zipper or resealable zip-lock closure mechanism to seal the interior cavity of the storage unit; and a clip formed as a unitary part of the storage unit and releasably attachable to the sweatband of the hat, the clip being configured to compressively engage the sweatband, wherein the storage system is flexible such that the storage system conforms to the shape of the interior region of the hat.

A further embodiment is disclosed wherein the storage unit is see-through; the clip comprises a magnet 128, 524 for attachment to a corresponding magnet 130 in the sweatband; the clip is rotatably fastened to the storage unit at a point of rotation such that the storage unit is rotatable at the point of rotation; the storage unit includes RFID protection material; and the storage system further including a hat configured to receive the storage unit and the clip.

Another embodiment of the present disclosure provides for a support clip for containing personal items and removable attachment to an interior region of a hat having a sweatband. The support clip being imperceptible by a third party when positioned in the interior region of the hat. The support clip includes a back portion configured to support the personal items between an outer surface of the back portion and an inner surface of the hat, the back portion comprising: a top region, a bottom region, and two side tabs being positioned between the top region and the bottom region of the back portion, the two side tabs being positioned closer to the bottom region than the top region of the back portion to provide a lower center of gravity for the support clip, the two side tabs including rounded corners to prevent snagging on other objects; and a clip portion formed as a unitary part of the back portion configured to be releasably engaged to the hat, such that the clip portion and the back portion form an acute angle that captures the sweatband, wherein the support clip is flexible such that the support clip conforms to the shape of the interior region of the hat.

Yet another embodiment is disclosed wherein the support clip further comprising a wallet including at least two slits; the at least two side tabs are configured to be inserted into the at least two slits of the wallet to support the wallet in the interior region of the hat; the sweatband of the hat includes at least two slits, the at least two side tabs being configured to be inserted into the at least two slits of the sweatband to support the personal items; the front portion includes a reinforced seam connecting the front portion to the back portion of the support clip; the reinforced seam includes a side cross-section that widens from the front portion to the back portion of the support clip; and the top portion of the back portion extends upwardly forming a half-moon shape.

BRIEF DESCRIPTION OF THE SEVERAL VIEWS OF THE DRAWING(S)

The accompanying drawings, which are included to provide further understanding of the present invention disclosed in the present disclosure and are incorporated in and constitute a part of this specification, illustrate aspects of the present invention and together with the description serve to explain the principles of the present invention. In the drawings:

FIG. 7 is a side elevational view of

DETAILED DESCRIPTION

Figure 1:
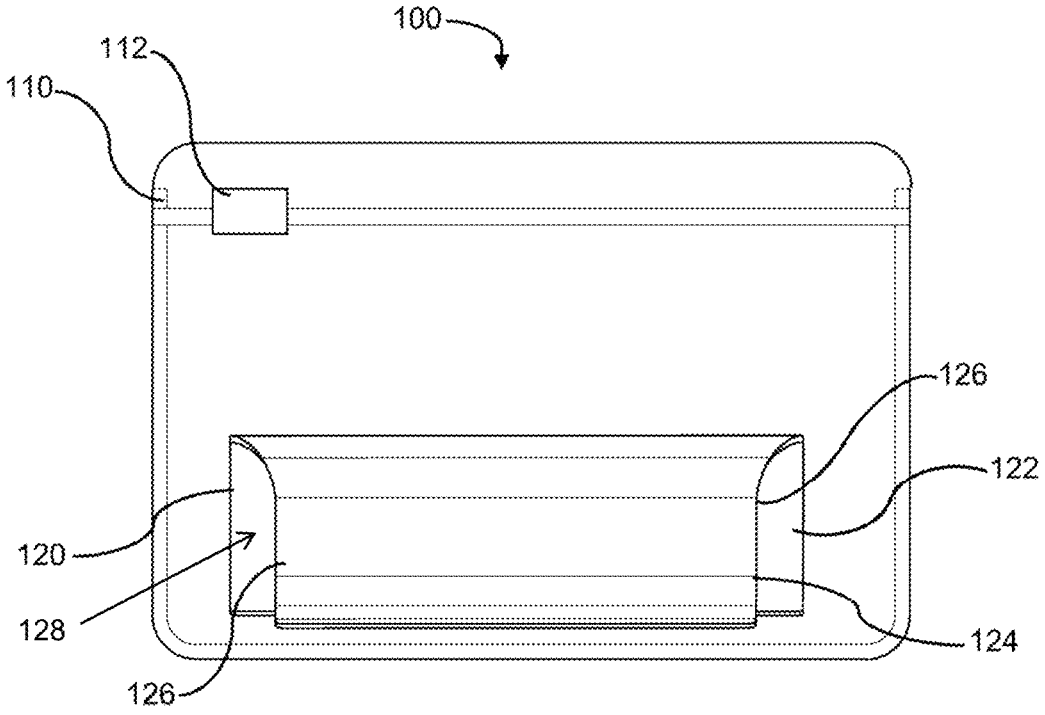
FIG. 1 is a perspective view of an embodiment of a removable storage clip of the present invention.

The detailed description set forth below is intended as a description of various configurations of the present invention and is not intended to represent the only configurations in which the present invention may be practiced. It will be apparent, however, to those of ordinary skill in the art that the present invention is not limited to the specific details set forth herein and may be practiced without these specific details.

It is to be appreciated that the present teaching is by way of example only, not by limitation. The concepts herein are not limited to use or application with a specific system or method. Thus, although the instrumentalities described herein are for the convenience of explanation, shown and described with respect to exemplary embodiments, it will be appreciated that the principles herein may be applied equally in other types of systems and methods.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal," "vertical," "left," "right," "up," and "down," as well as adjectival and adverbial derivatives thereof (e.g., "horizontally," "rightwardly," "upwardly," etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Removable Hat Clip Wallet

Referring now to the drawings, and more particularly to FIGS. 1-7, removable storage clips are provided, of which various embodiments are generally indicated at 100, 200, and 300. The removable storage clips 100, 200, 300 also are illustrated on articles of clothing including hats 104 and sweatbands 106, but may also be utilized with headbands, caps, headgear, and visors. The removable storage clip 100 includes a storage unit 110 and a fastener 120. The storage unit 110 may be a washable, waterproof envelope/wallet that sits inside a sweatband 106 of a baseball cap 104 or other hat with a band or inside seam upon which to clip the wallet 110.

Figure 2:
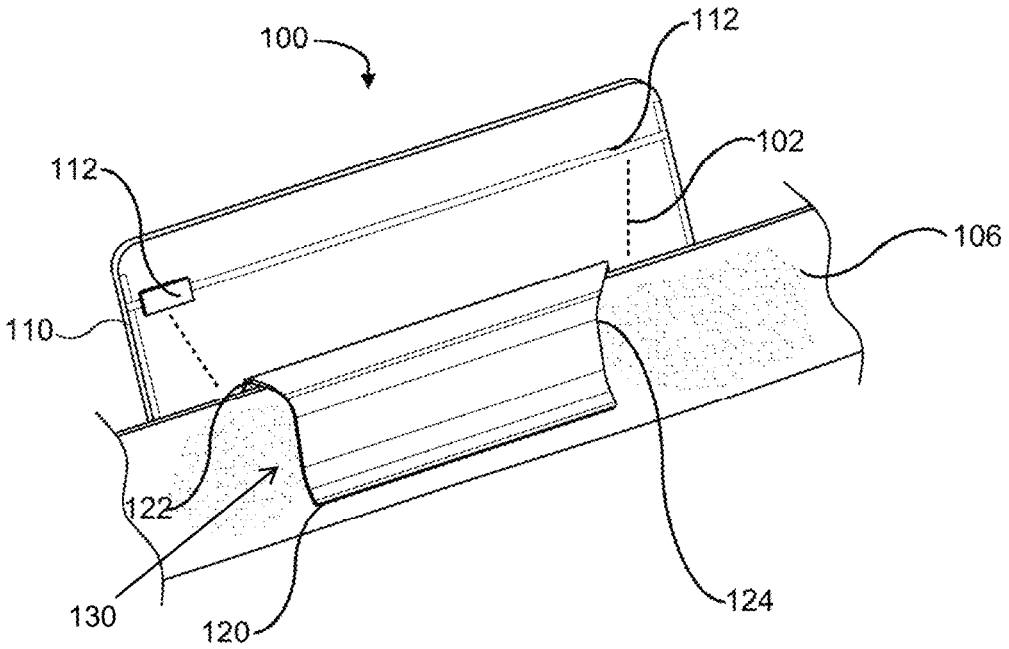
FIG. 2 is a perspective view of the removable storage clip of FIG. 1 inside of a sweatband.

The fastener 120 may be a clip/clasp and fixed to the wallet 110 that affixes to the hat's 104 sweatband 106 to remain securely in place. The clip 120 includes a back portion 122 that is attached (releasably or permanently) to the wallet 110 and a front portion 124 that assists in securing the removable storage clip 100 to the hat 104 or sweatband 106. A tip of the front portion 124 may be slightly bent away from the back portion 122 to create a gap that allows the clip 120 to more easily engage the hat 104 or sweatband 106. The front portion 124 includes two side ends 126 that taper inwardly at a sloped curve as shown in FIGS. 1 and 2 such that the width of the clip 120 is less than the width of the wallet 110 to facilitate attachment of the removable storage clip 100 to the hat 104 or sweatband 106.

The fastener 120 may also be held in place against the wallet 110 with a hook and loop fastener such as Velcro®, a metal fastener clip with hooks or teeth that latch on to fabric (such as a BandAce bandage wrap clip modified for attachment on one side to a wallet with the other, hooked side releasably attached to the sweatband 106 of the cap 104, for example), a snap, an adhesive, stitching, or a magnet 130 (incorporated in the sweatband 106 of the cap 104, for example). In certain aspects, the invention provides teeth or teeth clips around the edge of the clipping element 120 to help place the fastener 120 securely around the sweatband 106. Alternatively, both of the wallet 110 and the clip 120 may include corresponding magnets such that the wallet 110 is easily detachable from the clip 120 while the clip 120 remains attached to the hat 104 or the sweatband 106.

In this case, a part of the wallet 110 may be inside the sweatband 106 of the hat 104, but also stay inside the hat 104 due to the fastener 120, which slides along or is affixed to the sweatband 106. The wallet 110 may be a reusable clip wallet that may be removable to be used in baseball caps or other hats with sweatbands or similar bands within the interior of the hat 104 or other clothing and items such as a belt, a pouch, purse, inside a waistband, etc.

Unlike other hat storage systems, which are usually permanently built into a particular hat as a feature of the hat, the wallet 110 may allow a wearer the flexibility of having a storage system that can easily be used and reused with many hats. The wallet 110 may be a storage system for baseball caps 104 leveraging the sweatband 106 of the baseball caps 104 to fasten the storage system 100 partially inside the sweatband 106 of the cap 104. In a "trucker's hat," where a rear portion of the hat is partially see-through, the storage system 100 may be positioned towards a front portion of the hat so that the storage system 100 is not visible from outside viewers.

Figure 3:
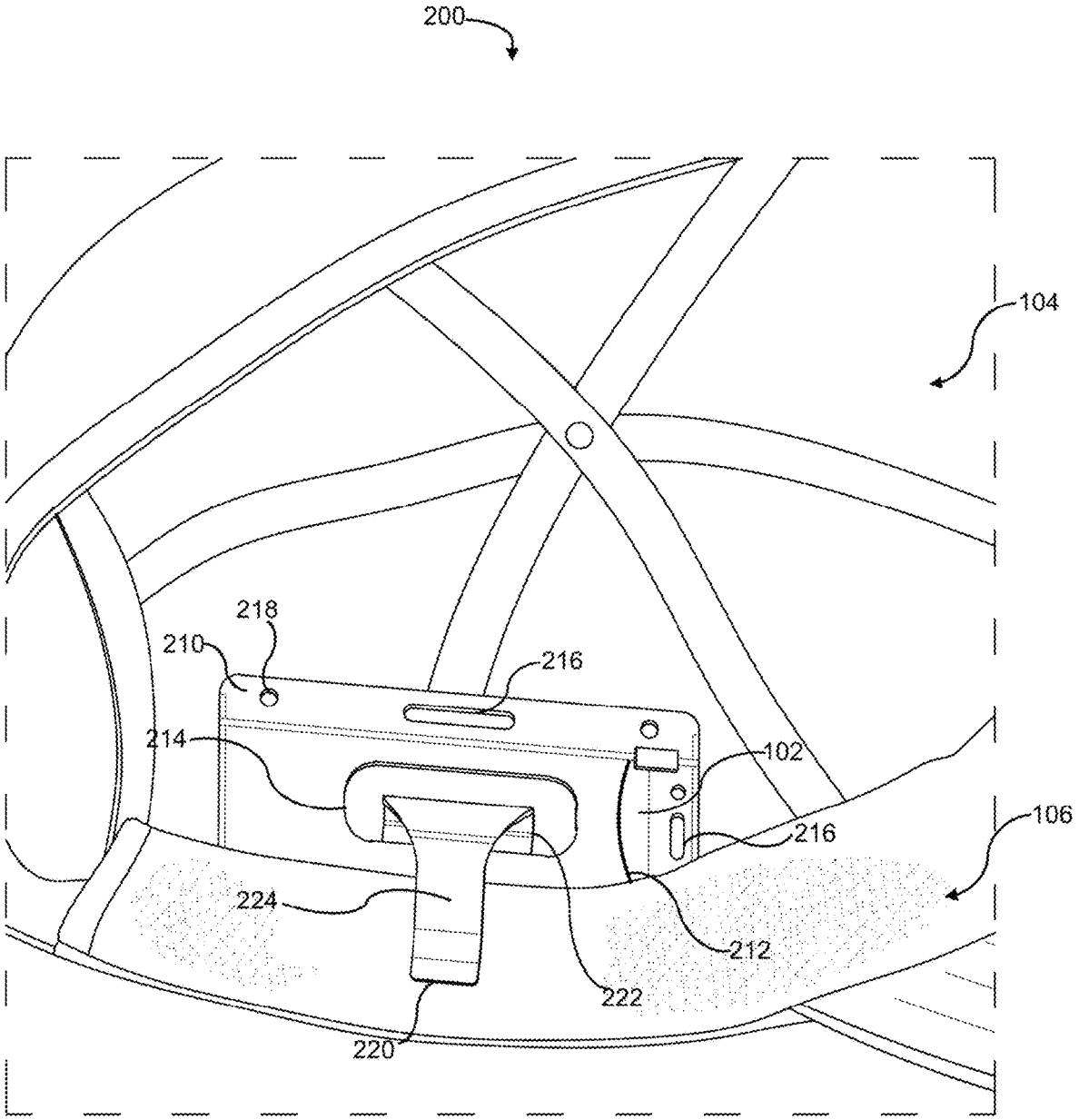
FIG. 3 is a perspective view of another embodiment of a removable storage clip inside of a hat.
Figure 4:
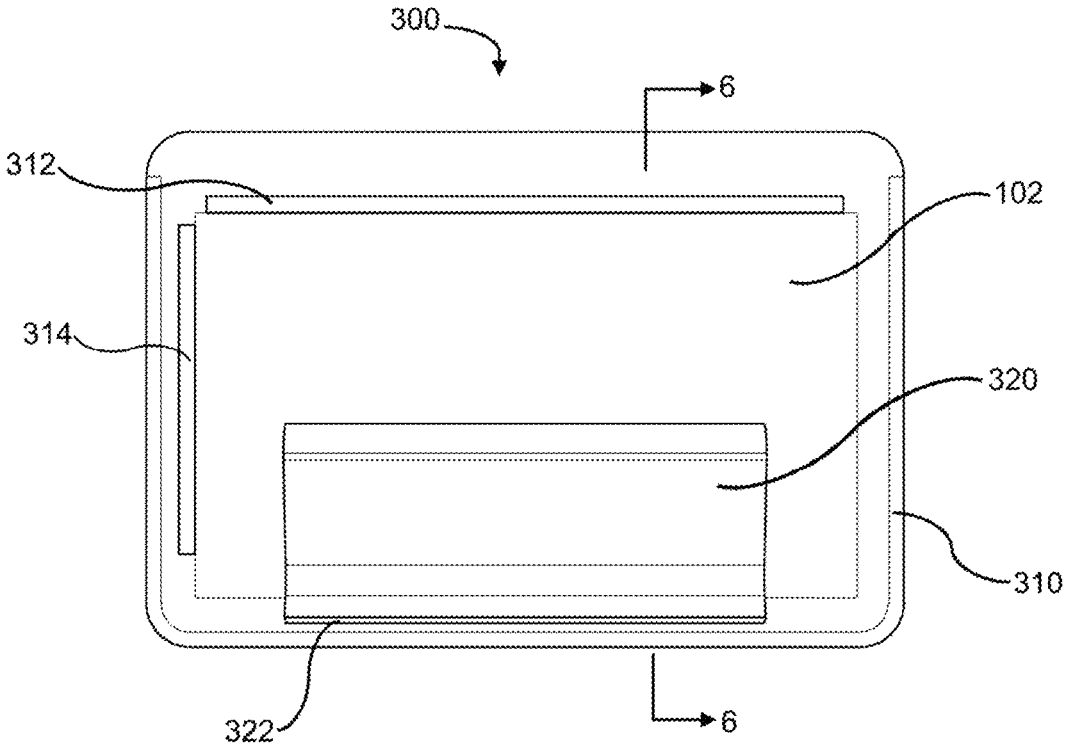
FIG. 4 is a side elevational view of yet another embodiment of a removable storage clip.
Figure 5:
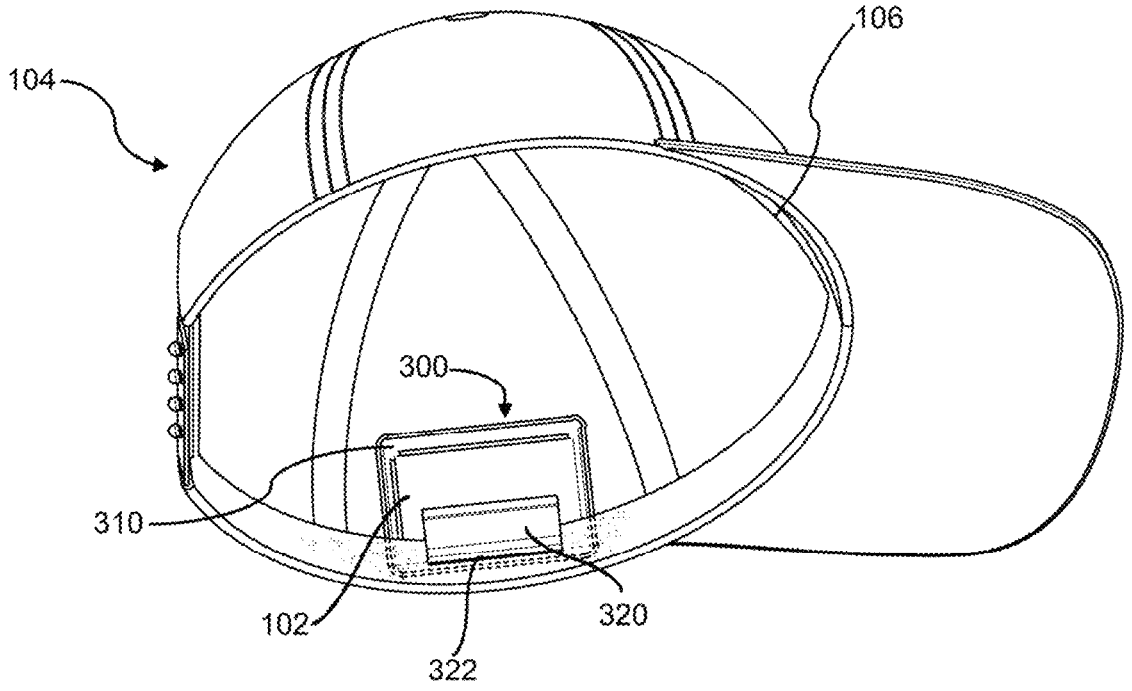
FIG. 5 is a perspective view of the removable storage clip of FIG. 4 in the hat.
Figure 6:
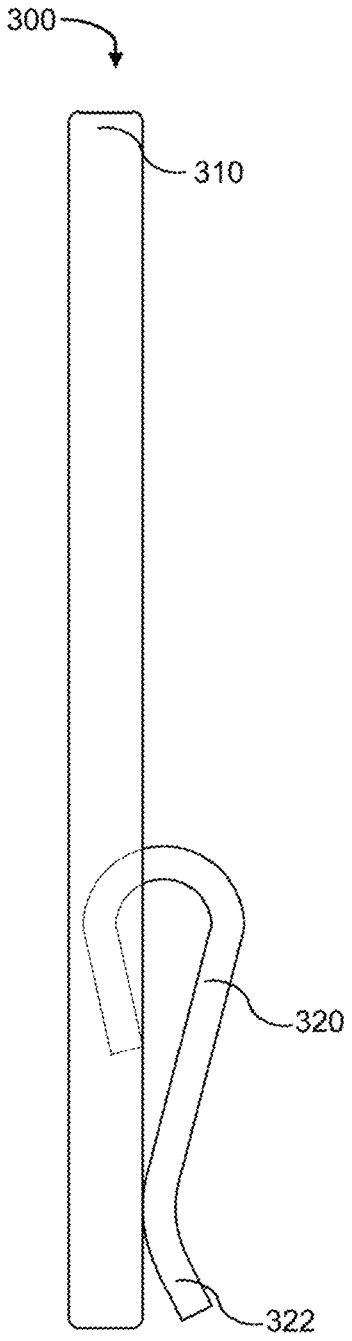
FIG. 6 is a side cross-sectional view of the removable storage clip of FIG. 4 along line 6-6 of FIG. 4.
Figure 7:
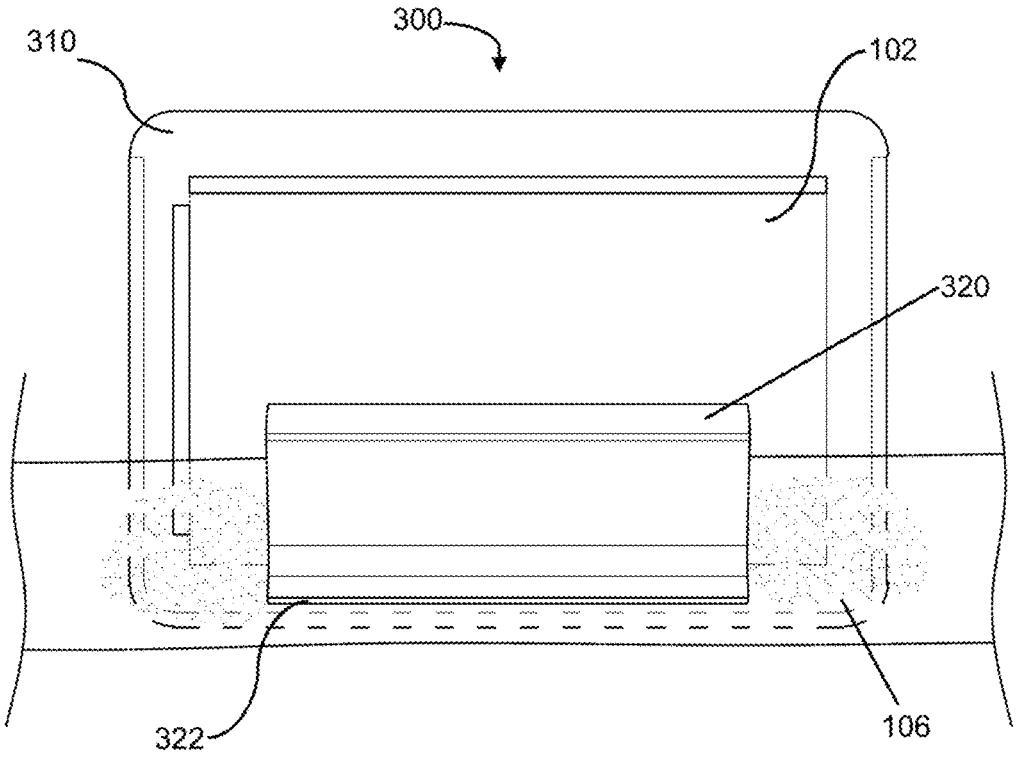

Referring to FIG. 3, the removable storage clip 200 includes a storage unit 210 and a fastener 220 that is removably attached to the storage unit 210 that easily secures the storage unit 210 to the sweatband 106 to secure the storage unit 210 in place in the hat 104, and may also be attached as described above. The storage unit 210 of the removable storage clip 200 may be a wallet and configured to store credit cards, licenses, discount cards, debit cards, membership cards, receipts, business cards, and movie tickets. The wallet 210 includes an access slot 212 to allow the user to insert personal items 102 into an interior region of the wallet 210. The wallet 210 may further include a fastener slot 214 (e.g., to attach the fastener as shown in FIG. 3), a lanyard slot 216 (e.g., to attach a lanyard), and a pin slot 218 (e.g., to attach a pin).

The access slot 212 is shown in FIG. 3 as a capsule-shape, however, other shapes are envisioned in the present invention such as circles, squares, rectangles, or any other polygonal shape suitable for the intended purpose and understood by a person of ordinary skill in the art. Furthermore, the access slot 212 may assist in the positioning of the wallet 210 in the hat 104 or sweatband 106. For example, if the access slot 212 is a square, the wallet 210 has two main positions (a vertical position and a horizontal position with respect to the sweatband 106). Depending on factors including, but not limited to, the density of the wallet 210, construction of the hat 104, and material of the wallet 210, the user may prefer one position over the other. The user may quickly adjust the position of the wallet 210 by turning the wallet 210, clockwise or counterclockwise, by 90 degrees.

The fastener 220 may be a clip or clasp and may be releasable from the wallet 210. The clip 220 includes a back portion 222 that is releasably attached to the wallet 210 and a front portion 224 that assists in securing the removable storage clip 200 to the hat 104 or sweatband 106. A tip of the front portion 224 may be slightly bent away from the back portion 222 to create a gap that allows the clip 220 to more easily engage the hat 104 or sweatband 106.

The clip wallet 210 may reside inside the hat closest to the brim/visor/lid part of the hat 104. The clip wallet 210 may be between the ear and the face on the side of the wearer's head, and may be made of material comfortable to the wearer such as faux leather, soft plastic, vinyl, or other soft waterproof materials suitable for the intended purpose and understood by a person of ordinary skill in the art.

Referring to FIGS. 4-7, the removable storage clip 300 includes a clip wallet 310 and a clip feature 320 built into the wallet 310 that easily secures the wallet 310 to the sweatband 106 to secure the wallet 310 in place in the hat 104, and may also be attached as described above. The clip feature 320 may include a lower portion 322 that is slight bent away from the wallet 310 to create a gap that allows the clip feature 320 to more easily engage the hat 104 or sweatband 106. The clip feature 320 may be made of metal, plastic, leather, carbon fiber, titanium, or any other material suitable for the intended purpose and understood by a person of ordinary skill in the art. Furthermore, the clip feature 320 may be built into the wallet 310 by methods including use of an adhesive, stitching, stapling, gluing, ironing, nailing, screwing, or any other methods suitable for the intended purpose and understood by a person of ordinary skill in the art.

The wallet 310 also may include access slots 312, 314, in which the personal items 102 can be inserted into the wallet 310. The access slots 312, 314 may utilize a zipper to seal the personal items 102 in the wallet 310. The zipper may also be a water-proof zipper to keep water from entering the interior portion of the wallet 310, thereby minimizing any damage to the personal items 102.

The clip wallet 310 may reside inside the hat closest to the brim/visor/lid part of the hat 104. The clip wallet 310 may be between the ear and the face on the side of the wearer's head, and may be made of material comfortable to the wearer such as faux leather, soft plastic, vinyl, or other soft waterproof materials suitable for the intended purpose and understood by a person of ordinary skill in the art.

The clip feature 120, 220, 320 and/or its wallet feature 110, 210, 310 may be: 1) invisible from outside the hat 104, and 2) difficult for persons to know the wallet 110, 210, 310 is present inside the hat 104, which provides a level of security and safety for the user where the wallet 110, 210, 310 is concealed. Whereas other hats with wallets or storage systems are easily viewed to persons other than the wearer, which increases risk of theft. The clip 120, 220, 320 may not be visible from outside the hat 104. The aesthetics of the hat 104 remain in place and do not jeopardize the fashion or existing look of the hat 104.

When the removable wallet 110, 210, 310 with the clip 120, 220, 320 is not used with the hat 104, the removable wallet 110, 210, 310 can be clipped or fastened to a person's day-to-day wallet or inside a purse or other items such as a belt, pouch, pants, backpack, shoulder bag, or other items. Unlike other pockets in hats 104, the storage system 100, 200, 300 may provide the flexibility of reusing the storage system for multiple hats, as well as added features. For example, the temporary attachment wallet 110, 210, 310 can be made of material that may be waterproof, washable, see through or not, and may be comfortable to the wearer. Due to the thin nature of the wallet 110, 210, 310, coupled with its materials, and as compared to a bulky pocket, there may be minimal discomfort to the wearer. The removable wallet 110, 210, 310 may further include RFID blocking material (passive or active) such as aluminum foil, copper, and nickel to prevent criminals from obtaining personal information from the user's personal items that utilize RFID technology.

The storage system 100, 200, 300 (e.g., a wallet) may include, and is not limited to, the following features: 1) removable and not permanent to any particular hat 104, 2) does not cause damage to the hat or require modification to the hat 104, 3) envelope/wallet clip 120, 220, 320 is reusable, 4) the storage system 100, 200, 300 leverages an existing sweatband 106 of a hat 104 by using a clipping mechanism that is attached to the storage system 100, 200, 300, 5) the wallet 110, 210, 310 and/or clip feature 120, 220, 320 of the storage system 100, 200, 300 may not be visible from the outside of the hat 104 (e.g., to maintain the aesthetics of the hat 104 and to help keep the wallet 104 from view of nefarious persons), and 6) provide a way to carry identification and other items when a person does not have a pocket or other way to carry information or is seeking a hands free way to keep identification and other items on the person. Additional features are identified in FIGS. 1-7.

Raised Sweatband Design for Storage

Another embodiment of the present invention may include a raised sweatband 400 that may be inside a hat 104 to provide for article storage 102. All baseball caps 104 and many hats 104 have a sweatband 106 built into the hat 104. On the inside of the sweatband 106, close to the brim/lid/visor part of the hat 104, a piece of plastic or other thick, secure material is inserted (e.g., sewn into the sweatband 106), which is in a half-moon shape 410 (or similar shape). The flat part of the half-moon 410 may rest inside the sweatband 106 of the hat 104, and the curved moon part 410 may stick up above the height of the sweatband 106, but still be covered by the same sweatband fabric material. "Raising" the sweatband 106 and providing extra support with the raised part by plastic allows and provides for storage for licenses, credit cards, or other articles in between the raised sweatband portion 400 and inside the hat 104.

Figure 8:
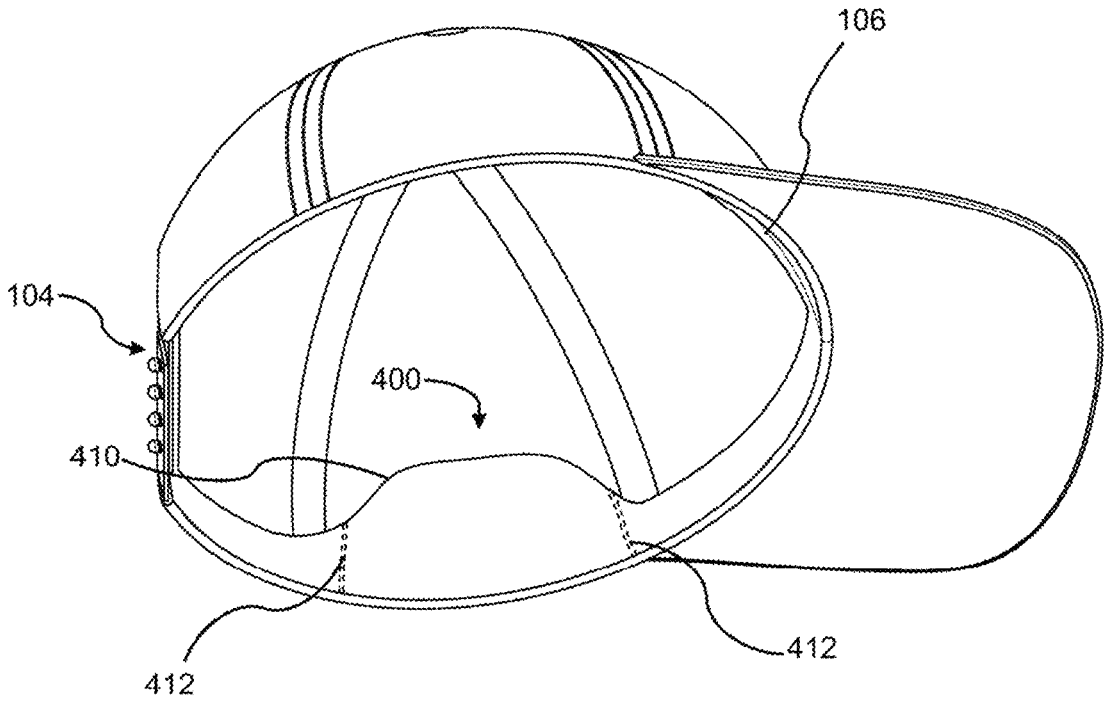
FIG. 8 is a perspective view of an embodiment of a raised sweatband of the present invention.

In addition to the plastic inserted into the raised shape 410 of the sweatband 106, there may be stitching 412 from the front of the hat seam where the sweatband 106 meets the baseball cap brim. In lieu of the stitching 412, the side ends of the raised shape 410 may include corresponding fasteners (e.g., clips or clasps) to attach the raised shape 410 to the sweatband 106. Alternatively, a cap 104 itself may be manufactured with a portion of the sweatband raised 400 (e.g. half-moon shaped). Once again, these embodiments may allow for the storage of licenses, credit cards, or other similar sized items. Additional features are identified in FIG. 8.

Insertable Hat Support Clip

Figure 9:
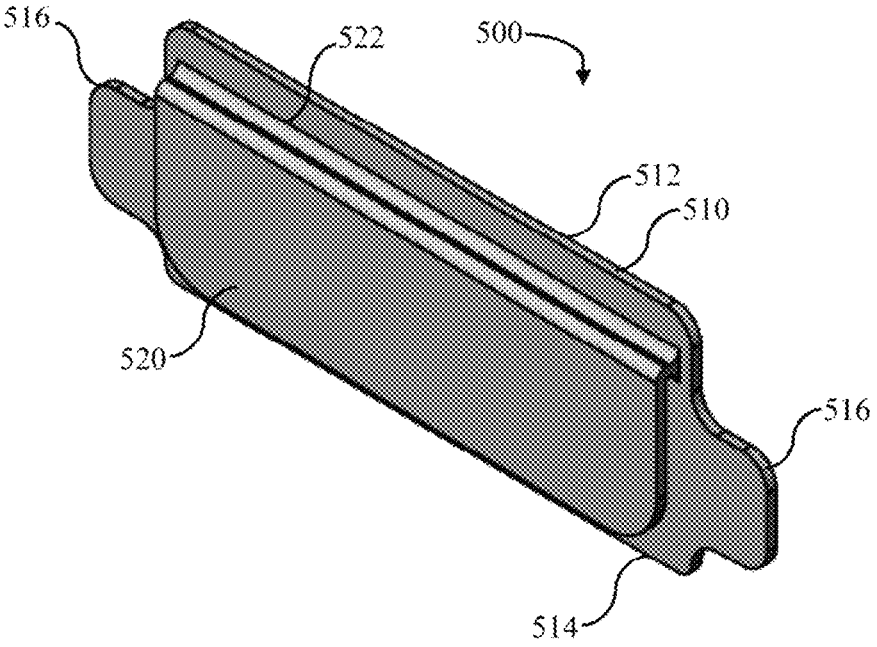
FIG. 9 is a perspective view of an embodiment of a support clip of the present invention.
Figure 10:
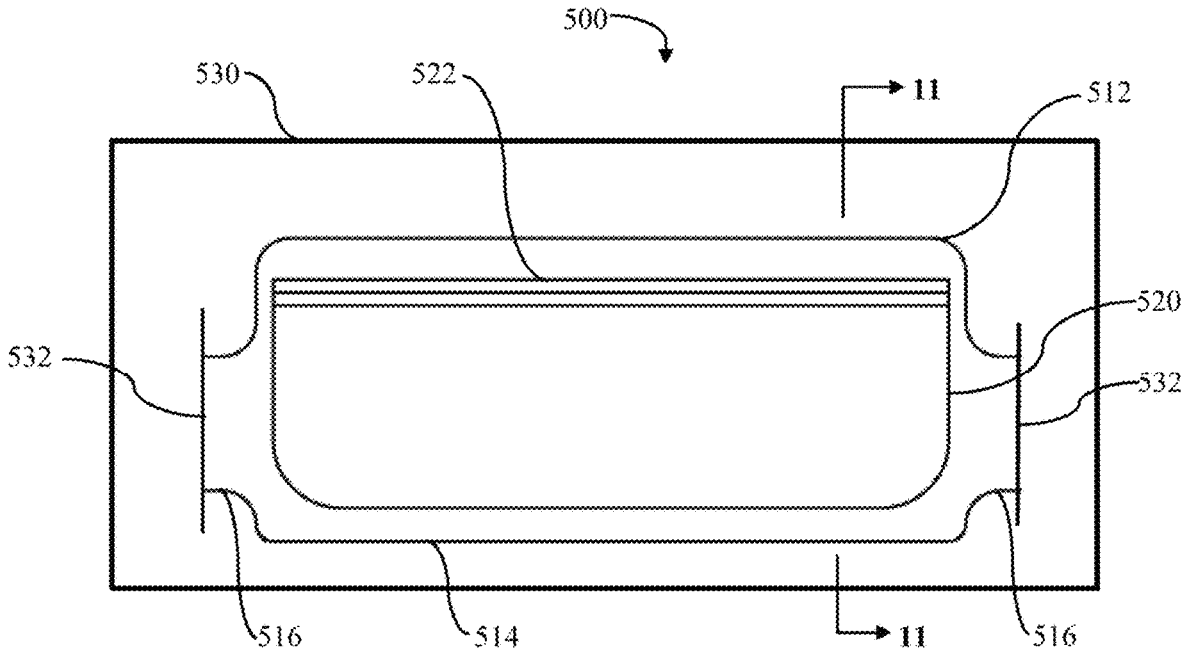
FIG. 10 is an elevational view of the support clip of FIG. 9 assembled with a storage unit.
Figure 11:
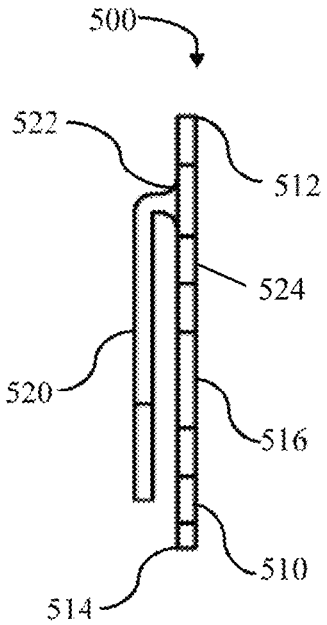
FIG. 11 is a side cross-sectional view of the support clip of FIG. 9 along line 11-11 of FIG. 10.

Referring to FIGS. 9-11, an insertable hat support clip is provided, of which an embodiment is generally indicated at 500. The insertable hat storage clip 500 is shown as broadly including a back portion 510 connected to a front portion 520. The back portion 510 of the clip 500 includes a top portion 512, a bottom portion 514, and two side tabs 516. After the front portion 520 secures the clip 500 in place in a hat 104 or sweatband 106 (as similarly described above for the clip 120), the back portion 510 acts as additional support (as similarly described above for the half-moon shape 410 of the raised sweatband 400) to contain or secure in place personal items 102 such as credit cards, driver's license, and receipts. The top portion 512 of the back portion 510 extends past the top of the sweatband 106 to support the vertical portions of the personal items 102.

The side tabs 516 of the back portion 510 also provide additional support when the clip 500 is inserted into the sweatband 106 or the hat 104. The side tabs 516 may extend past the sides of the personal items 102 to provide maximum support of the personal items 102 in the hat 104. The side tabs 516 also extend sideways past the top portion 512 and the bottom portion 514 of the clip 500. The side tabs 516 taper downwardly from the top portion 512 and upwardly from the bottom portion 514 of the clip 500. The side tabs 516 are also positioned closer to the bottom portion 514 of the support clip 500 to provide a lower center of gravity so that the support clip 500 is more fully supported when attached to an article of clothing.

The clip 500 also may be utilized with a wallet 530 having two slits 532. The side tabs 516 may be inserted into the corresponding slits 532 of the wallet 530 such that the wallet 530 is supported in the hat 104 by the clip 500, as similarly described above in FIGS. 1-7. Alternatively, the side tabs 516 may be inserted into corresponding slits on the inner portion of the sweatband 106, while the front portion 520 engages the outer portion of the sweatband 106. Thus, providing additional "engagement" support of the support clip 500 to the sweatband 106, while still supporting the personal items 102.

The front portion 520 may be connected to the back portion 510 of the clip 500 by a reinforced seam 522, wherein a side cross-section of the reinforced seam 522 becomes wider at its base, towards the back portion 510, to provide structural support to the front portion 520 as the reinforced seam 522 is a stress point as the user continuously opens and closes the clip 500.

The back portion 510 and the front portion 520 of the support clip 500 may include rounded edges to deter from snagging against the hat 104, the sweatband 106, or any other article of clothing. The back portion 510 of the support clip 500 may further extend upwardly similar to the half-moon shape 410 of the raised sweatband 400 to provide additional support of the personal items 102. The raised sweatband 400 and the support clip 500 also may be: 1) invisible from outside the hat 104, and 2) difficult for persons to know the raised sweatband 400 and the support clip 500 are present inside the hat 104, which provides a level of security and safety for the user where the raised sweatband 400 and the support clip 500 are concealed. Similar to the storage clips 100, 200, 300 above, other hats with wallets or storage systems are easily viewed to persons other than the wearer, which increases risk of theft. The raised sweatband 400 and the support clip 500 may not be visible from outside the hat 104. The aesthetics of the hat 104 remain in place and do not jeopardize the fashion or existing look of the hat 104. It is also contemplated that the clips 100, 200, 300, 400, 500 may not be completely flat, but may be curved such that the clips 100, 200, 300, 400, 500 are more comfortable to the user when inserted into the elastic band of shorts or a hat 104. For example, the user may not necessarily store credit cards in the clips 100, 200, 300, 400, 500. The user may store receipts or passports in the clips 100, 200, 300, 400, 500, and a curved clip would be a more comfortable clip from the two embodiments for the user.

The invention has been described in detail with particular reference to a present preferred embodiment, but it will be understood that variations and modifications can be effected within the spirit and scope of the invention. The presently disclosed embodiments are therefore considered in all respects to the illustrative and not restrictive. The scope of the invention is indicated by the appended claims, and all changes that come within the meaning and range of equivalents thereof are intended to be embraced therein.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

What is claimed is:

1. A storage system for containing personal items and removable attachment to an interior region of a hat having a sweatband, the storage system being imperceptible by a third party when positioned in the interior region of the hat, the storage system comprising:

a storage unit being configured to be secure, waterproof, and for storing the personal items, the storage unit comprising:

an interior cavity for receiving the personal items; and a zipper or resealable zip-lock closure mechanism to seal the interior cavity of the storage unit and a clip formed as a unitary part of the storage unit and releasably attachable to the sweatband of the hat, the clip being configured to compressively engage the sweatband, wherein the storage system is flexible such that the storage system conforms to the shape of the interior region of the hat and wherein the clip comprises a magnet for attachment to a corresponding magnet in the sweatband.

2. The support clip of claim 1, further comprising the hat configured to receive the storage unit and the clip.

3. A support clip for containing personal items and removable attachment to an interior region of a hat having a sweatband, the support clip being imperceptible by a third party when positioned in the interior region of the hat, the support clip comprising:

a back portion configured to support the personal items between an outer surface of the back portion and an inner surface of the hat, the back portion comprising:

a top region, a bottom region, and two side tabs being positioned between the top region and the bottom region of the back portion, the two side tabs being positioned closer to the bottom region than the top region of the back portion to provide a lower center of gravity for the support clip, the two side tabs including rounded corners to prevent snagging on other objects; and a clip portion formed as a unitary part of the back portion configured to be releasably engaged to the hat, such that the clip portion and the back portion form an acute angle that captures the sweatband, wherein the support clip is flexible such that the support clip conforms to the shape of the interior region of the hat and further comprising a wallet including at least two slits.

4. The support clip of claim 3, wherein the two side tabs are configured to be inserted into the at least two slits of the wallet to support the wallet in the interior region of the hat.

5. A support clip for containing personal items and removable attachment to an interior region of a hat having a sweatband, the support clip being imperceptible by a third party when positioned in the interior region of the hat, the support clip comprising:

a back portion configured to support the personal items between an outer surface of the back portion and an inner surface of the hat, the back portion comprising:

a top region, a bottom region, and two side tabs being positioned between the top region and the bottom region of the back portion, the two side tabs being positioned closer to the bottom region than the top region of the back portion to provide a lower center of gravity for the support clip, the two side tabs including rounded corners to prevent snagging on other objects; and a clip portion formed as a unitary part of the back portion configured to be releasably engaged to the hat, such that the clip portion and the back portion form an acute angle that captures the sweatband, wherein the support clip is flexible such that the support clip conforms to the shape of the interior region of the hat and wherein the clip portion includes a reinforced seam connecting the clip portion to the back portion of the support clip.

6. The support clip of claim 5, wherein the reinforced seam includes a side cross-section that widens from the clip portion to the back portion of the support clip.

* * * * *